United States Patent [19]

Goldstein et al.

[11] Patent Number: 4,806,095

[45] Date of Patent: Feb. 21, 1989

[54] FUEL VALVE CONTROL SYSTEM

[75] Inventors: Mark K. Goldstein, La Jolla; Earl M. Dolnick, Encinitas, both of Calif.

[73] Assignee: Quantum Group, Inc., San Diego, Calif.

[21] Appl. No.: 147,262

[22] Filed: Jan. 21, 1988

Related U.S. Application Data

[63] Continuation-in-part of Ser. No. 701,369, Feb. 13, 1985, abandoned.

[51] Int. Cl.[4] ..... F23Q 9/08

[52] U.S. Cl. ..... 431/54; 431/46; 137/65

[58] Field of Search ..... 431/46, 51–55; 137/65, 66

[56] References Cited

U.S. PATENT DOCUMENTS

| | | | |
|---|---|---|---|
| 2,304,641 | 12/1942 | Jones | 431/79 |
| 2,388,124 | 10/1945 | Crews | 431/79 |
| 2,408,954 | 10/1946 | Ray | 431/79 |
| 2,607,415 | 8/1952 | Jordan | 431/55 |
| 2,695,056 | 11/1954 | Caparone et al. | 431/55 |
| 2,924,270 | 2/1960 | Deziel | 431/79 |
| 3,358,738 | 12/1967 | Chambers | 431/51 |
| 3,765,820 | 10/1973 | Ito et al. | 431/75 |
| 3,975,137 | 8/1976 | Hapgood | 431/79 |
| 4,028,047 | 6/1977 | Strunz et al. | 431/355 |
| 4,370,557 | 1/1983 | Axmark et al. | 431/79 |

*Primary Examiner*—Carroll B. Dority, Jr.
*Attorney, Agent, or Firm*—Christie, Parker & Hale

[57] ABSTRACT

A fail safe gas shut off system is provided for a gas appliance. Two normally closed valve stages are provided in series, with each stage operated by a bidirectional solenoid armature. When the armature moves in one direction, the first stage of the valve is opened to supply gas to a pilot burner and to the second stage of the valve. When the pilot flame heats an emissive element to produce sufficient radiation, a photovoltaic device illuminated by the emissive element produces current for an electromagnet which latches the first stage of the valve in its open position. The armature can then move in the opposite direction and open the second stage of the valve to supply gas to the main burner. In the event of pilot flame failure, the emissive element darkens, and current from the photovoltaic device ends. The electromagnet releases the first stage of the valve which is biased closed and cuts off gas flow to both the pilot and main burners.

10 Claims, 1 Drawing Sheet

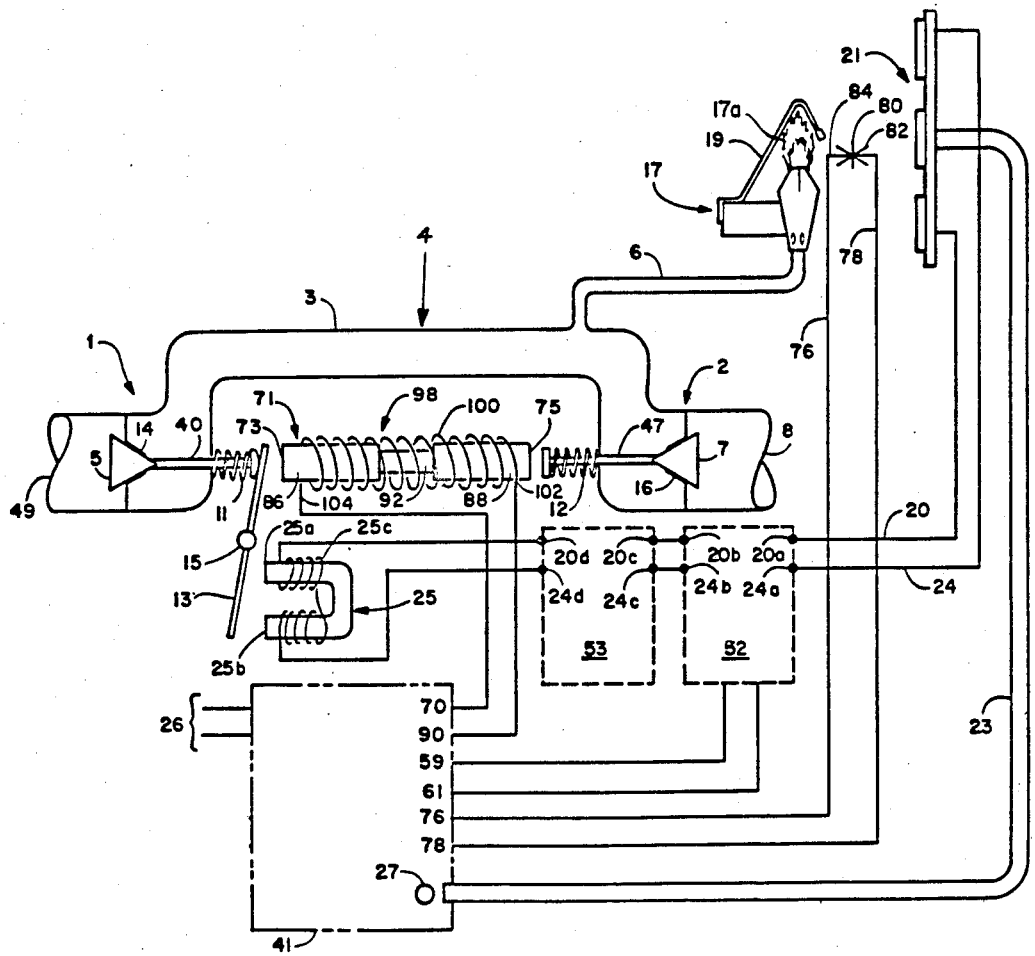
21
84
80
82
17a
19
17
78
6
4
3
76
1
2
71
98
100
75
14
40
73
47
8
5
7
49
11
86
104
92
88
102
12
16
20
25a
25c
15
20d
20c
20b
20a
24
13
25
24d
24c
24b
24a
53
52
25b
26
70
90
59
61
76
78
23
27
41

FUEL VALVE CONTROL SYSTEM

BACKGROUND OF THE INVENTION

This application is a continuation in part of U.S. patent application Ser. No. 701,369, filed Feb. 13, 1985 and now abandoned, the subject matter of which is hereby incorporated by reference.

Devices used for producing heat by means of combustion of a fuel gas are in common use throughout the world. Typically, such devices are comprised of a gaseous fuel source connected to a control valve which is in turn connected to a burner wherein the combustion occurs. Many such devices also have ignition systems to initiate the combustion process.

In the past, most heaters had a small continuously burning pilot flame to provide a source of ignition. Since the cost of energy has risen in recent years, this standing pilot has gradually been eliminated, and replaced by the introduction of electronic ignition systems.

If any of the unburned fuel gas were to leak, a dangerous condition would result. For this reason, a flame detector is usually provided to shut off the flow of fuel gas if the combustion flame should cease. In small heating devices the safety system usually comprises a thermoelectric device such as a thermocouple placed in the pilot flame, which powers a safety electromagnet located within the control valve. When the electromagnet is powered, a normally closed valve with a closing spring biasing the valve closed is latched in the open position, allowing the flow of fuel gas. If the flame fails, the thermoelectric device cools, which reduces its electrical output. Eventually the output drops low enough that the electromagnet is released, allowing the closing spring to shut off the valve, terminating the supply of fuel gas.

Since the thermoelectric device typically has a large thermal mass, the cooling process takes a substantial amount of time. In fact 20 to 60 seconds may elapse before the valve closes. For small heaters, such a long delay can be tolerated. Larger heaters, such as those with capacities of 400,000 BTU/HR and greater, have a much larger gas flow rate, and a considerable amount of unburned gas may flow out of the burner if the valve stays open in the absence of a flame. For this reason, the larger heaters are required to have a flame failure response time not exceeding four seconds. Thus, thermoelectric devices are unsuitable. Also, since these large heaters usually have electric controls and igniters without standing pilots, the heat-up delay of typical thermoelectric sensors is also unsuitably long.

Many devices have been developed to provide the fast flame sensing function. Smith et al., U.S. Pat. Nos. 2,748,846, and Serber, 4,505,299, both describe a flame rectifier wherein the rectifying characteristics of the flame are exploited.

The use of optical sensing of the flame has been described for over 50 years. Ito et al., U.S. Pat. No. 3,765,820, describe the optical sensing of a luminous element in the flame for the purpose of controlling the fuel/air ratio and hence the combustion efficiency. Jones, U.S. Pat. No. 2,304,641, teaches that the direct light from the flame fluctuates whereas the emissive light from the hot burner surface is constant. The difference is exploited for flame detection. Ray, U.S. Pat. No. 2,408,954, teaches the use of a photomultiplier type light detector to directly sense the presence of the flame.

Hapgood, U.S. Pat. No. 3,975,137, also uses the direct optical sensing of the flame, as does Crews, U.S. Pat. No. 2,388,124. Axmark and Satren, U.S. Pat. No. 4,370,557, look at the both the optical spectrum and flicker frequency characteristic of the flame. All of these devices commonly use the light issued by the flame directly or by the surrounding hot areas, as a signal to additional, independently powered electric or electronic circuits to sense the presence or absence of a flame. The flame rectifiers also require such external circuitry. Since the gas valve safety circuit is powered by the external circuit under the control of the flame sensor, it is possible that a failure of one or more elements in the external circuit could open the gas valve and cause a dangerous situation to occur.

The present invention is an extension of the principles taught in our previous copending application PCT/US No. 84/01038. In this invention, the photovoltaic control system described in the previous application is extended to include electrically controlled gas valves. An emissive element is placed in ,the flame. A photovoltaic device converts a portion of the resultant visible and infrared radiation to electric power which is used to power the safety electromagnet of the valves. The valves are adapted with safety electromagnets which are functionally identical to the safety electromagnets used in thermoelectric safety systems, but they are powered, not by thermoelectric devices, but instead by the photovoltaic device without the need for external amplifying circuits or external power supplies. All power for the safety circuit is derived from the flame only. Thus, the fast response time that is characteristic of the emissive element/photovoltaic system is obtained, and the system is inherently safe since no failure of any element of the safety circuit can lead to unintended opening of the gas valve.

BRIEF SUMMARY OF THE INVENTION

The present invention is a control system and gas valve for a gas combustion device which has been adapted for use with a photovoltaic powered safety system. The gas valve is specially adapted to provide a high degree of safety in operation.

The gas valve has two valve stages in series, each resiliently biased toward the closed position. The stages are disposed at either end of a common solenoid mechanism. The mechanism can move in either of two directions. Movement in a first direction causes the opening of the first stage. This allows the flow of gas to the pilot burner and to the second stage. Movement in a second direction opens the second stage. This would allow passage of the fuel gas to the burner if the first stage were also open. But the mechanism can only move in one direction or the other, and thus, there is no way that it can erroneously open both stages of the valve.

Mechanically linked to the first stage and to the solenoid mechanism is a safety electromagnet powered by the photovoltaic means. If the electromagnet is energized, it can latch open the first stage. Since the mechanism can not move in two directions at the same time, there is no way that it can hold open both the first and second stages. The only way gas can flow to the main burner is for the first stage to be latched open by the safety electromagnet and for the mechanism to open the second stage. The inherent safety of this system will become apparent.

DESCRIPTION OF THE DRAWING

The drawing is a semi-schematic illustration of one embodiment of the invention.

DESCRIPTION OF AN EMBODIMENT OF THE INVENTION

A gas input pipe 49 is connected to one side of the input port 1 of a gas valve assembly 4. A first valve stage comprising a first valve plug 5 and a first valve seat 14 is placed within the input port 1. An intermediate gas pipe 3 conveys gas from the output side of the input port to the input side of the output port 2 of the gas valve. Placed within the output port 2 is a second valve plug 7 with a second valve seat 16. A gas pipe 8 connects the output side of output port with the main burner of a gas appliance such as a space or water heater (not shown). Also connected to the intermediate pipe 3 by a conduit 6 is a pilot burner assembly 17.

One end of a first extension shaft 40 is connected to the first valve plug 5. The other end of the extension shaft 40 is connected to one end of a first compression spring 11. The other end of the spring is connected to the body of the gas valve assembly. The spring 11 is arranged so that in its extended position, it holds valve plug against the valve seat, preventing the flow of gas through the input port. Thus, the first valve stage is normally closed, being resiliently biased toward the closed position by the spring.

The second stage is biased toward the closed position in a similar manner. One end of an extension shaft 47 is connected to the valve plug 7. The other end is connected to one end of a second valve spring 12. The other end of valve spring is connected to the body of gas valve assembly. The valve spring is arranged so that in its extended position, it holds the valve plug against the valve seat 16, preventing the flow of gas through the downstream second port.

The springs are placed opposite each other on a common axis. They are spaced apart so that a solenoid assembly 98 comprised of a magnetic armature 71 with a solenoid coil 100 concentrically wound around it, can be placed between them. The magnetic armature 71 has a first end 73 adjacent to the first spring 11 and a second end 75 adjacent to the second spring 12. It may be made of one magnet (not shown) or two magnets 86 and 88 separated by a nonmagnetic spacer 92. Whatever geometry for magnetic armature is chosen, a construction for the solenoid coil 100 can be chosen so that when the current flows in one direction in the coil, the magnetic armature is urged in one direction along the common axis, and when the direction of current flow in the coil is reversed, the magnet armature is urged in the opposite direction. Alternatively, two coils can be used for urging the armature in either of the opposite directions. A single coil is preferred since this avoids conflicting forces on the armature.

Placed between one end 73 of the magnetic armature and the free end of the first spring 11 is one end of a lever arm 13, arranged so that the motion of the magnetic armature pressing against one end of the lever arm and the spring 11 causes a rotation of the lever arm about a fulcrum point 15. An electromagnet 25 comprised of a U-shaped pole piece with two parallel pole faces **25*a* and 25*b* and wound with winding 25*c***, is placed so that when the lever arm rotates, the lower side of the lever arm is pressed against the open pole faces, thus closing the magnetic circuit of the electromagnet.

The winding **25*c* of the electromagnet is connected by conductors 20 and 24 to a photovoltaic array 21 which is placed near and facing an emissive element 19. The emissive element may be a fine wire or mesh, or the like, for emitting radiation to which the photovoltaic device 21** is sensitive when heated by the flame of the pilot burner. By using a fine element with low thermal mass, there is rapid cooling below incandescence or quantum emission temperatures, thereby providing fast response time in the event the pilot flame is extinguished.

Control elements 52 and 53 may be placed in series or across the conductors 20 and 24. A control circuit 41 connects to the solenoid coil 100 at terminals 70 and 90, to the control element 52 at terminals 59 and 61, and to an electric ignitor 80 placed in the vicinity of the pilot burner 17 via conductors 76 and 78. Power input to the control circuit 41 is via the conductors 26, and may be conventional utility power, or current from a photovoltaic array (not shown) illuminated by an emissive element in the main burner flame, stored in a battery for use when the flame is out. The control circuit 41 may utilize optical flame detection by way of a fiber optic cable 23 with one end pointed at the emissive element 19 and the other end connected to a photosensitive input 27 of the control circuit 41.

The system works in the following way: Assume that heat is desired. The control circuit 41 applies power via conductors 76 and 78 to the electric ignitor 80. Power is also applied via terminals 70 and 90 to the coil 100 of the solenoid 98. The polarity is such that the magnetic armature 71 is urged in the direction to press on the end of the lever arm and the free end of the spring 11, thus compressing it. The lever arm 13 rotates about fulcrum point 15 until the lower end of the lever arm presses against the pole faces **25*a* and 25*b* of the electromagnet 25. The motion of the armature is transmitted via the extension shaft 40 to the valve plug 5, causing it to move away from the valve seat 14, thus allowing the flow of gas into the intermediate pipe 3, and thence to the pilot gas pipe 6 and to the pilot burner 17. The electric ignitor 80 ignites the gas issuing from the pilot burner 17. The resultant flame 17*a* heats the emissive element 19** to incandescence.

A portion of the radiation thus illuminates the photovoltaic array 21, producing electric current which flows via conductors 20 and 24 to the coil **25*c* of the electromagnet 25. The lever 13 is held by magnetic attraction to the pole faces of electromagnet. The other end of the lever arm holds the spring 11 in the compressed state, and keeps the first stage of the valve open. The control circuit now senses that the pilot burner is operating. This may be achieved by monitoring the emissive radiation from the emissive element 19 by means of the fiber optic light guide 23 or by monitoring the current flow from the photovoltaic array 21** by means not shown.

The control circuit 41 now terminates the power flowing to the electric ignitor 80, and reverses the polarity of the power flowing to the coil 100 of the solenoid 98. The magnetic armature 71 is now urged in the opposite direction, and presses on the end of the spring 12, compressing it. The motion of the armature is transmitted by the extension 12 to the valve plug 7, causing it to move away from the valve seat 16. Gas now flows through the output port 2 to the gas pipe 8 and to the main burner (not shown), where it is ignited by the flame issuing from the pilot burner 17. The main burner may be terminated by removing the power from the coil 100. The pilot burner may be terminated by interrupting the flow of current to the coil 25c of the electromagnet 25. This may be easily accomplished by energizing the control circuit 52 via the conductors 59 and 61. The control circuit 52 may either disconnect the circuit or shunt the current around electromagnet 25. With either method, the flow of current to the electromagnet 25 is interrupted. The lever arm 13 now rotates away from the pole faces 25a and 25b, releasing the spring 11, and closing the first stage input valve, shutting off the flow of gas. Exactly the same thing would happen if the flame were to fail; the emissive element would rapidly cool, thereby ending generation of power from the photovoltaic device and interrupting current to the electromagnet.

Thus, this system provides rapid flame failure response, and, by virtue of the fact that no external power is required by the safety circuit, it is inherently fail-safe. It provides an economical fast shut-off system for larger appliances it is preferable since less costly than flame rectifiers and the like.

Although one embodiment of this invention has been described and claimed herein, many modifications will be apparent to one skilled in the art. Thus, for example, other structures of valve and holding magnet may be preferred for other embodiments. Control devices illustrated are merely exemplary and should not be regarded as required for practice of this invention. It is therefore to be understood that within the scope of the appended claims, this invention may be practiced otherwise than as specifically described.

What is claimed is:

1. A valve for a gas appliance comprising:

normally closed pilot valve means for controlling gas flow to a pilot flame;

normally closed main valve means for controlling gas flow to a main burner;

a bidirectional solenoid for alternatively opening the pilot valve means or the main valve means; and an electromagnet for latching the pilot valve means in the open position in response to presence of a pilot flame.

2. A valve as recited in claim 1 further comprising an emissive element positioned for heating by the pilot flame, a photovoltaic device for illumination by the emissive element, and means for connecting the photovoltaic device to the electromagnet for supplying current to the electromagnet.

3. A valve as recited in claim 1 comprising means for conveying fuel gas from the pilot valve means to the main valve means, and a pilot burner connected for receiving gas from the conveying means.

4. A valve for a gas appliance comprising:

a first solenoid operated valve for connection to a source of fuel gas;

means for resiliently biasing the first solenoid valve toward its closed position;

a second solenoid operated valve connected in series with and downstream from the first solenoid valve;

means for resiliently biasing the second solenoid valve toward its closed position;

a pilot burner connected between the first and second solenoid valves;

a main burner connected to the second solenoid valve;

a solenoid actuator connected to both solenoid valves for alternatively operating the first solenoid valve or the second solenoid valve; and electromagnetic means for selectively latching the first solenoid valve in its open position.

5. A valve as recited in claim 4 further comprising an emissive element positioned for heating by the pilot flame, a photovoltaic device for illumination by the emissive element, and means for connecting the photovoltaic device to the electromagnetic means for supplying current thereto.

6. A fail safe gas control system for a gas appliance having a pilot burner and a main burner comprising:

a first normally closed fuel gas valve for controlling fuel to both the pilot burner and the main burner;

a second normally closed fuel gas valve in series with the first valve for controlling fuel to the main burner;

an emissive element adjacent to the pilot burner for heating by the pilot burner;

a photovoltaic device for illumination by the emissive element;

a solenoid actuator for sequentially opening the first and second valves; and an electromagnet electrically connected to the photovoltaic device for latching the first valve in its open position in response to current generated in the photovoltaic device by illumination from the emissive element.

7. A control system as recited in claim 6 wherein the solenoid actuator comprises a single bidirectional actuator for separately opening each valve in sequence.

8. A fail safe gas control system for a gas appliance having a pilot burner and a main burner comprising:

a first fuel gas valve for controlling fuel to both the pilot burner and the main burner;

means for resiliently biasing the first valve toward its closed position;

a second fuel gas valve in series with the first valve for controlling fuel to the main burner;

means for resiliently biasing the second valve toward its closed position;

an emissive element adjacent to the pilot burner for heating by the pilot burner;

a photovoltaic device for illumination by the emissive element;

a bidirectional solenoid for alternatively opening the first or second valves; and means connected to the photovoltaic device for maintaining the first valve open only when the photovoltaic device is illuminated by the emissive element.

9. A two stage safety valve for a gas appliance comprising:

a first valve stage for connection to a source of fuel gas;

means for resiliently biasing the first valve stage toward its closed position;

a second valve stage connected in series with and downstream from the first valve stage;

means for resiliently biasing the second valve stage toward its closed position;

a pilot burner connected between the first and second valve stages;

a main burner connected to the second valve stage;

a mechanical actuator connected to both valve stages for alternatively operating the first valve stage or the second valve stage; and electromagnetic means for selectively latching the first valve stage in its open position.

10. A valve as recited in claim 9 further comprising an emissive element positioned for heating by the pilot flame, a photovoltaic device for illumination by the emissive element, and means for connecting the photovoltaic device to the electromagnetic means for supplying current thereto.

* * * * *